United States Patent [19]

Bentivenga et al.

[11] Patent Number: 5,051,714

[45] Date of Patent: Sep. 24, 1991

[54] MODULAR RESONANT CAVITY, MODULAR DIELECTRIC NOTCH RESONATOR AND MODULAR DIELECTRIC NOTCH FILTER

[75] Inventors: Salvatore Bentivenga, Manalapan; Gregory J. Lamont, Englishtown, both of N.J.

[73] Assignee: Alcatel NA, Inc., Hickory, N.C.

[21] Appl. No.: 490,933

[22] Filed: Mar. 8, 1990

[51] Int. Cl.[5] ..... H01P 7/06; H01P 1/208

[52] U.S. Cl. ..... 333/227; 333/212; 333/219.1; 333/230

[58] Field of Search ..... 333/202, 219.1, 208–212, 333/227, 230, 231, 235

[56] References Cited

U.S. PATENT DOCUMENTS

| | | | |
|---|---|---|---|
| 4,260,967 | 4/1981 | Flieger | 333/212 X |
| 4,489,293 | 12/1984 | Fiedziuszko | 333/212 |
| 4,721,933 | 1/1988 | Schwartz et al. | 333/212 |
| 4,862,122 | 8/1989 | Blair, Jr. et al. | 333/202 |
| 4,940,956 | 7/1990 | Garner | 333/227 X |

FOREIGN PATENT DOCUMENTS

| | | | |
|---|---|---|---|
| 0139501 | 8/1983 | Japan | 333/212 |
| 0165205 | 6/1989 | Japan | 333/219.1 |
| 0731498 | 6/1955 | United Kingdom | 333/212 |

*Primary Examiner*—Eugene R. LaRoche
*Assistant Examiner*—Seung Ham
*Attorney, Agent, or Firm*—Peter C. Van Der Sluys

[57] ABSTRACT

Modular resonant cavities particularly for use in applications associated with high frequency electromagnetic energy each comprise a shell defining an aperture formed therethrough, and either end plates and/or divider closure plates, each having stepped-down regions for interfitting at perimeter ends of adjacent shells so as to form a resonant cavity. The modular resonant cavities include support rods passing through the corner regions of each closure plate. Fastening means at each end of the rods mechanically secure the modular resonant cavities together. The modular resonant cavities are particularly suited for forming dielectric notch resonators and in particular, such dielectric notch resonators having a centrally positioned resonators within the aperture defined by each shell and a coupling reactance mechanism formed by an inductive coupling wire and a capacitive element connected in series thereto so as to form a dielectric notch resonator with a relatively narrow bandwidth and with a small imaginary component about its operating center frequency. Dielectric notch filters using a plurality of such dielectric notch resonators further comprise a coupling transmission line which connects to each dielectric notch resonator resulting in an overall filter having a shorter overall length than comparable filters formed by prior art dielectric notch resonators. The resulting dielectric notch filter has a lower electrical loss than previous dielectric notch filters using longer coupling transmission lines.

38 Claims, 10 Drawing Sheets

MODULAR RESONANT CAVITY, MODULAR DIELECTRIC NOTCH RESONATOR AND MODULAR DIELECTRIC NOTCH FILTER

FIELD OF THE INVENTION

The present invention relates to resonant cavities and dielectric notch resonator and filters fabricated therefrom. Such filters can be used as notch filters for attenuating the reception of electromagnetic energy within a given bandwidth, wherein the bandwidth represents a relatively small percentage of the center frequency of the attenuated energy. The invention is particularly directed to resonant cavities and associated dielectric notch filters for attenuating signals in the ultra-high frequency (UHF) range with attenuation bandwidths of less than one percent of the central frequency being attenuated.

BACKGROUND OF THE INVENTION

Cellular telephone communications have in recent years become extremely popular in the United States and other parts of the world. The Federal Communication Commission (FCC) originally allocated specific frequencies for transmission and reception of such cellular communications. Due to the success and popularity of such cellular communication, the FCC later allocated additional frequencies in order to make more channels available. Due to the need for maintaining compatibility with the originally allocated frequencies of 870–890 megahertz (mhz) for transmission and 825–845 mhz for reception and the sub-bands therein allocated between non-wireline service and wireline service, these additional frequencies were allocated relatively narrow bandwidths for both non-wireline and wireline service.

As a result of this increase in bandwidth and the resulting addition of two additional sub-bands for reception and transmission, a means for filtering unwanted frequencies for both the non-wireline and wireline services became critical. In particular with regard to the wireline service, an additional non-wireline 1.5 mhz sub-band which lies between the two wireline sub-bands must be effectively attenuated for wireline reception.

As set forth in the present assignee's U.S. Pat. 4,862,122, dielectric notch filters have been developed that have the desired characteristics of presenting a relatively low impedance having a primarily resistive characteristic within a fairly narrow bandwidth of frequencies while maintaining a relatively small physical size in comparison to other filters. Such a dielectric notch filter also has a high quality factor (Q) so as to present little attenuation outside of the desired frequencies. The specific details associated with the dielectric notch resonators used in such filters is set forth in the present assignee's U.S. Pat. No. 4,896,125, entitled Dielectric Notch Resonator. Such prior art resonators and dielectric notch filters found therefrom have achieved the desired results of narrow bandwidth and relatively small physical size while operating in the UHF frequency range.

The present invention sets forth a new resonant cavity design and the resulting dielectric notch resonators and dielectric notch filters that can be formed therefrom.

In particular, the present invention results in a resonant cavity formed in an integrated modular fashion. These cavities form the housings for dielectric notch resonators, which in turn can be coupled to form a dielectric notch filter. In particular, the individual resonant cavities can share common walls by means of divider closure plates which are dimensioned to interfit with the interior perimeter of a shell forming the remaining portion of the resonant cavity. This design reduces the materials necessary for forming the individual cavities as well as the physical space which otherwise would be necessary if duplication of parts were required. Furthermore, because of the modular design of each resonant cavity, the cavities can be stacked together to form a single multi-cavity housing forming part of an overall dielectric notch filter. Due to the closeness of the cavities to one another, electrical losses associated with a coupling transmission line are reduced as compared to such prior art multi-resonant cavity dielectric notch filters.

The overall result is a modular resonant cavity and dielectric notch resonator and filter formed therefrom which exhibit desired high frequency attenuation characteristics. The modular dielectric notch filters are particularly suited for cellular communication applications. The modular design of the resonant cavities reduces materials and labor costs and also allows for easy modification of the desired characteristics of the associated dielectric notch filter by changing the size of the resonant cavity shell.

SUMMARY OF THE INVENTION

An improved resonant cavity is disclosed which can be fabricated in a modular fashion. Dielectric notch resonators and dielectric notch filters formed from these cavities are particularly suited for attenuating narrow bandwidths of ultra-high frequency electromagnetic energy such as that used in cellular communication receivers. Their modular cavity design is easier and less expensive to fabricate than prior art dielectric notch filters. The resonant cavities share common walls which reduce the amount of parts and space otherwise required to fabricate devices, such as dielectric notch filters, which require a plurality of dielectric notch resonators formed from individual resonant cavities.

The resonator cavity shell may preferably be fabricated from a length of square cross-sectional aluminum extrusion. The shells are separated by divider closure plates such as fabricated from machined aluminum. A pair of end closure plates close the end of the outermost cavity shells. The plates may be stepped on each face so as to aid in attachment to the cavity shells. The shell and divider plates are stacked alternately and held together by four rods which pass through the corners of each plate. The rods are threaded on each end and protrude through the end closure plates so as to allow tightening by nuts; thereby compressing the modular resonant cavities so as to maintain structural rigidity. A dielectric notch filter formed from such resonant cavities can be used as band pass filters, band stop filters, and low pass and high pass filters. The modular cavities can also be used in other applications requiring multiple resonant cavities.

OBJECT OF THE INVENTION

It is therefore a principal object of the present invention to provide a resonant cavity which is modular in construction, wherein individual cavities are separated from each each other by common divider closure plates which interfit with the perimeter of the shells to form overall cavities.

Another object of the present invention is to provide modular resonant cavities wherein the shells and divider closure plates are stacked alternately and are held by rods passing through the corners of these plates and end closure plates so as to provide mechanical rigidity to the modular cavities through tightening of nuts threaded on the ends of the rods.

A still further object of the present invention is to provide modular resonant cavities which are particularly suited for fabricating modular dielectric notch resonators and modular dielectric notch filters.

Another object of the present invention is to provide dielectric notch filters that minimize the length of the associated coupling transmission line, thereby reducing the electrical losses otherwise associated with a larger coupling transmission line.

Other objects of the present invention will in part be obvious and will in part appear hereinafter.

BRIEF DESCRIPTION OF THE DRAWINGS

For a fuller understanding in the nature of the objects of the present invention, reference should be made to the following detailed description taken in connection with the accompanying drawings in which.

BEST MODE FOR CARRYING OUT THE INVENTION

Figure 1:
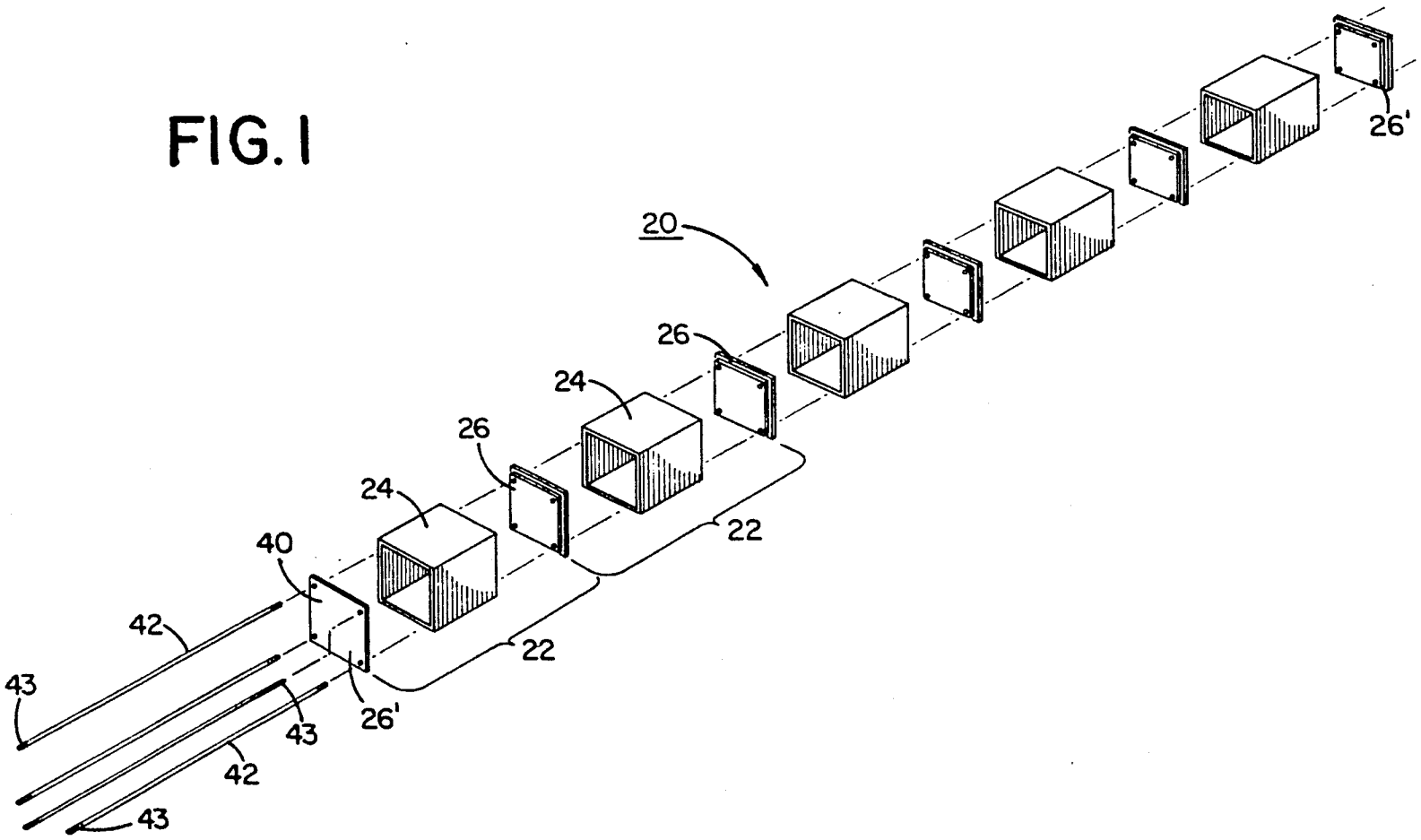
FIG. 1 is an exploded representation of modular resonator cavities fabricated according to the present invention, wherein these cavities can be used to form modular dielectric resonators and a dielectric notch filter by coupling the individual resonators.
Figures 2, 2A:
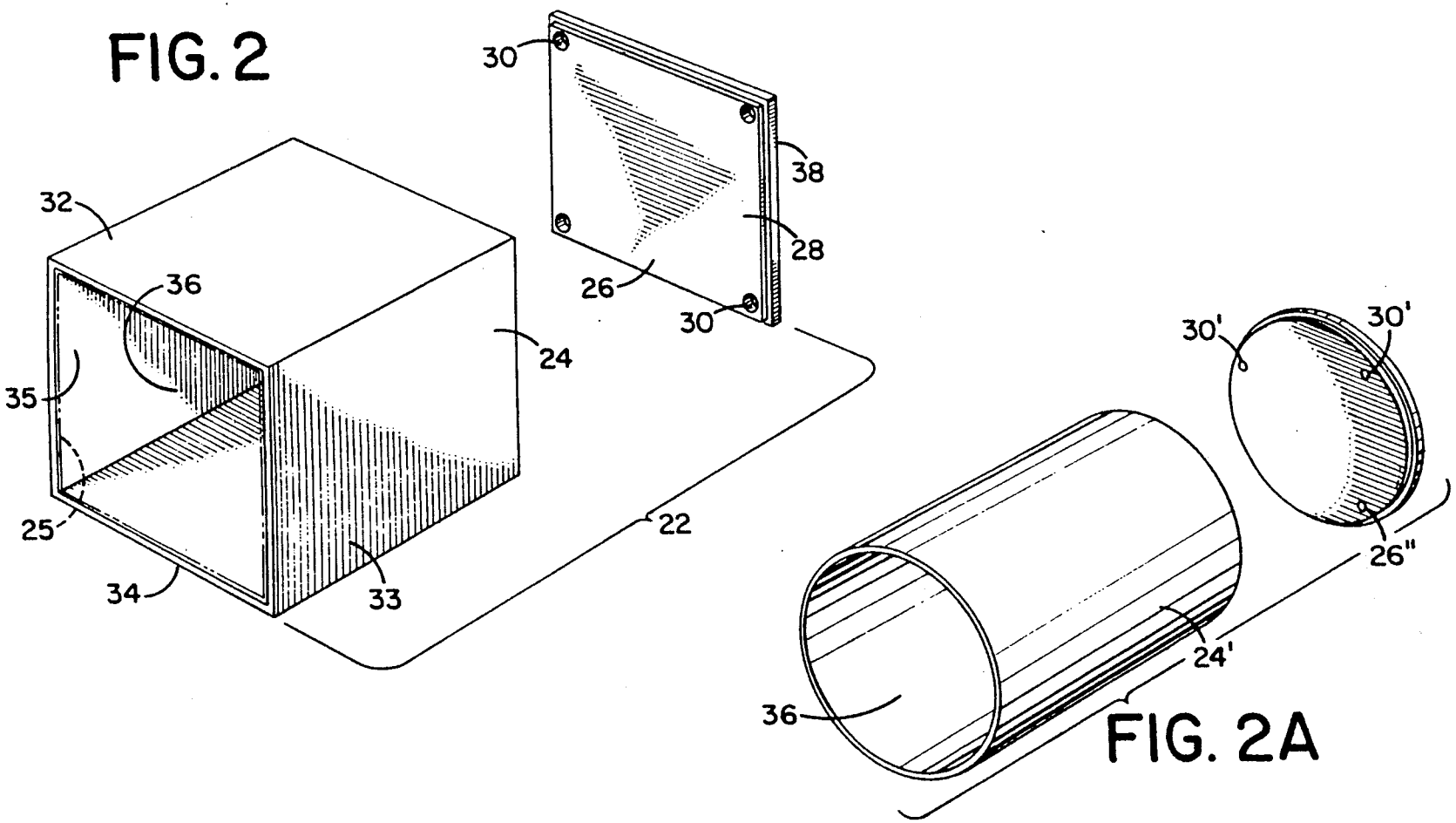
FIG. 2 is an exploded enlarged view of a resonator cavity shown in FIG. 1, illustrating the use of a stepped divider closure plate for enclosing one end of the cavity shell while having a corresponding stepped region on its obverse side for mating with the adjacent cavity shell to form the next modular resonant cavity.
FIG. 2A is an exploded enlarged view of an alternative embodiment of a resonator cavity according to the present invention.
Figure 3A:
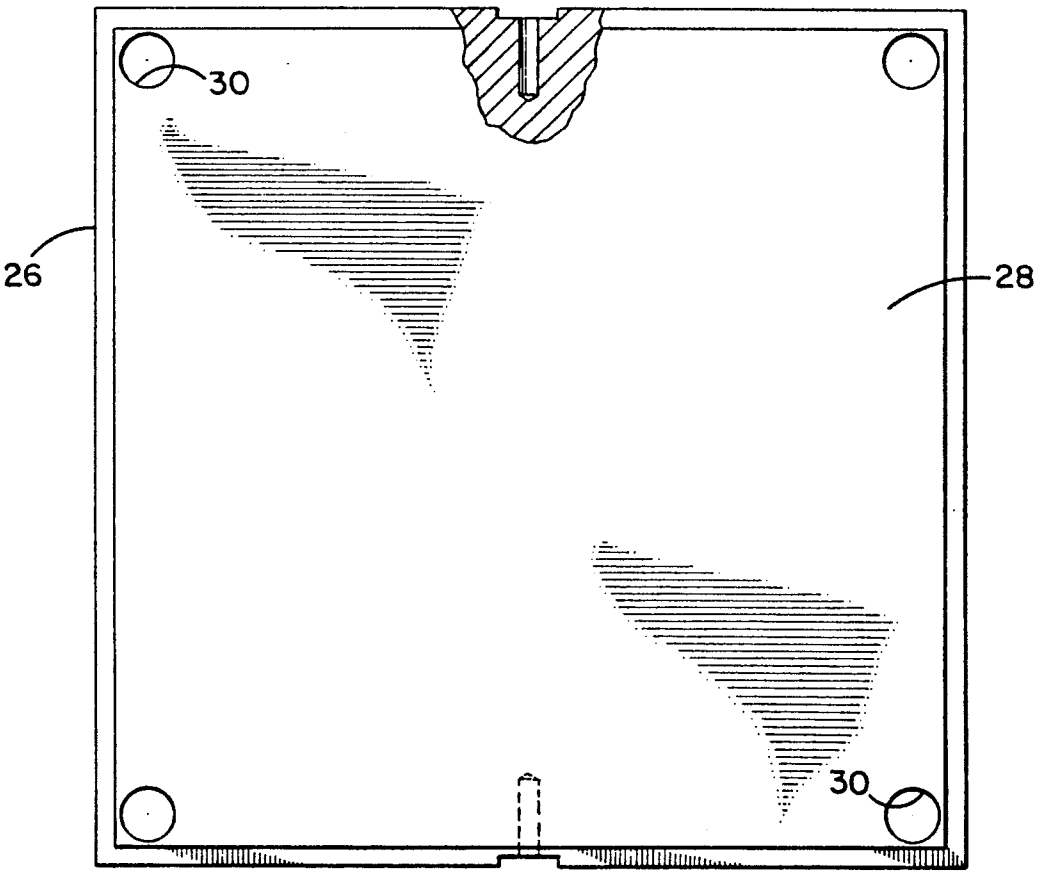
FIG. 3A is a front view of the divider closure plate shown in FIGS. 1 and 2.
Figure 4A:
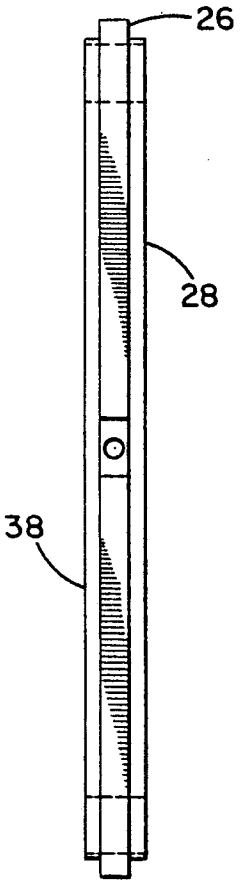
FIG. 4A is a side view of the closure plate shown in FIGS. 1, 2 and 3A.
Figure 3B:
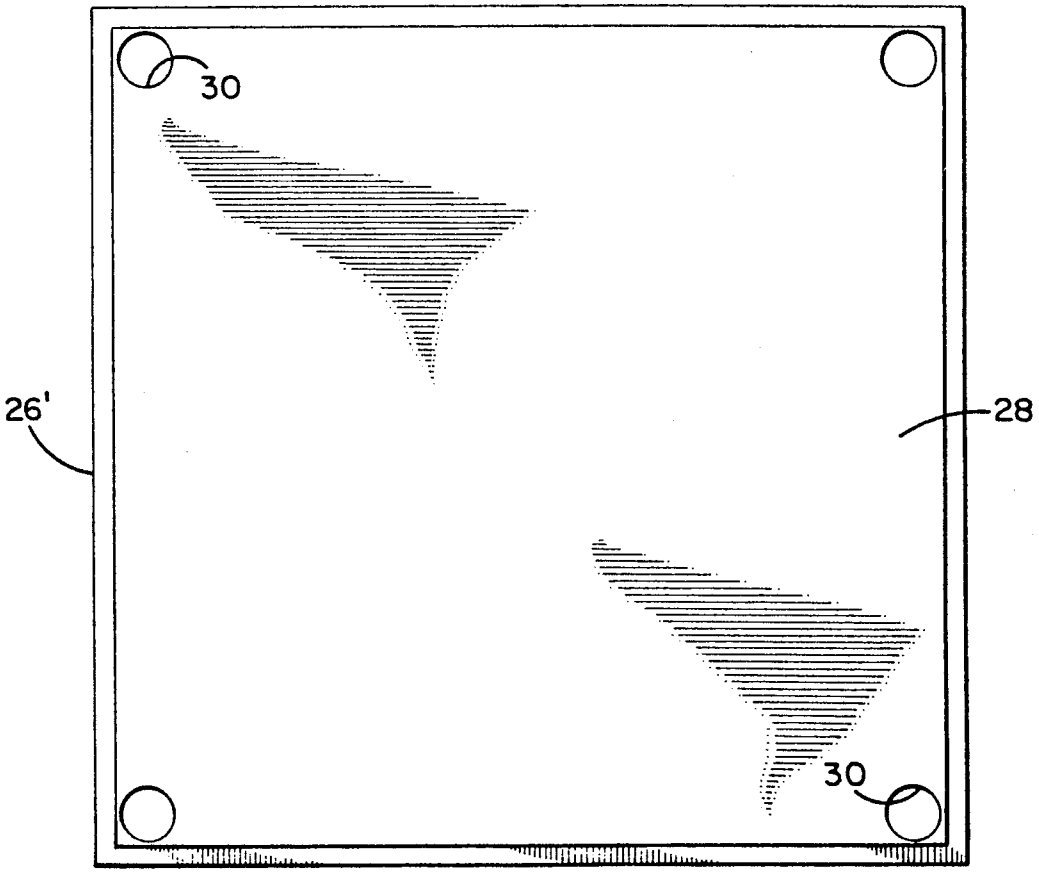
FIG. 3B is a front view of the end closure plate shown in FIG. 1.
Figure 4B:
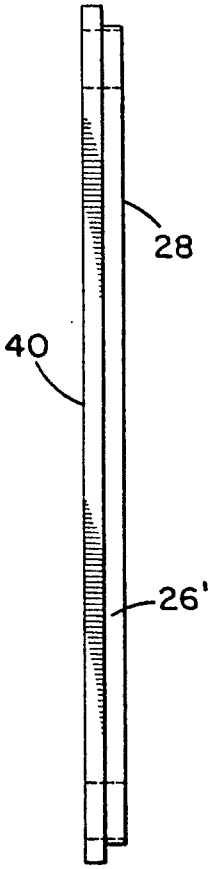
FIG. 4B is a side view of the end closure plate shown in FIGS. 1 and 3B.

As best seen in FIGS. 1, 2, 8, 9 and 10, a modular dielectric notch filter 20 according to the present invention comprises a plurality of modular resonant cavities 22, each cavity forming a dielectric notch resonator 23. The theoretical operation of such resonators is described in *The Feynman Lectures on Physics,* Vol II, Chapter 23 (Addison-Wesley Publishing Co., 1964). As seen in FIGS. 1 and 2, the exterior of each modular resonant cavity incorporates a shell 24 defining an aperture 36 and two divider closure plates 26 or one divider closure plate and one end closure plate 26'. Each closure plate may include a raised stepped portion 28 and four apertures 30 passing through the stepped portion at each corner thereof. The stepped portion is dimensioned for interfitting with the interior perimeter edge of shell 24 as shown by dotted lines 25 along the interior of shell wall sections 32, 33, 34 and 35. As seen in FIGS. 3A and 4A, each divider closure plate is positioned between adjacent shells 24 and includes a stepped portion on its reverse side 38 so as to interfit with the adjacent shell. As seen in FIGS. 1, 3B and 4B. each end closure plate 26' only has a stepped portion on the face adjacent the shell with a flat surface along its other face, such as face 40 shown in FIG. 1.

It should be noted that although a stepped portion of the closure plate is used in the preferred embodiment, that other alignment means can be used to help align the divider or end closure plates with the adjacent shell. For instance, the closure plate can simply have outwardly extending tabs or flanges which are positioned to contact the perimeter edge of the adjacent shell.

In the preferred embodiment of the present invention the shell is fabricated from copper plated aluminum extrusion while the closure plate is fabricated from copper plated aluminum sheet stock. The extrusion material has a typical wall thickness of 0.125 inch (3.18 mm). As seen in FIG. 4A, the divider closure plate has an overall thickness, including the stepped portions, of approximately 0.375 inch (9.53 mm). The stepped portions each have a thickness of approximately 0.094 inch (2.4 mm). As seen in FIGS. 3B and 4B, the end closures have an overall thickness of approximately 0.25 inch (6.4 mm) and a stepped portion thickness of 0.125 inch (3.2 mm). In addition, for a resonant cavity having a resonant frequency of approximately 845 mhz, the shell has a square cross-section with each side approximately five inches (12.7 cm) in length and an extrusion length of approximately 5.625 inches (14.29 cm).

Figure 8:
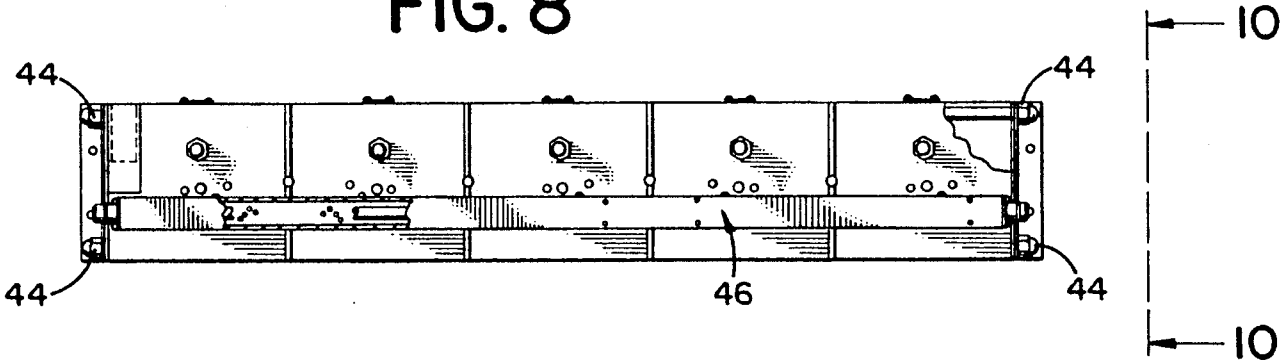
FIG. 8 is a top plan view of a modular dielectric notch filter formed in accordance with the present invention.
Figure 9:
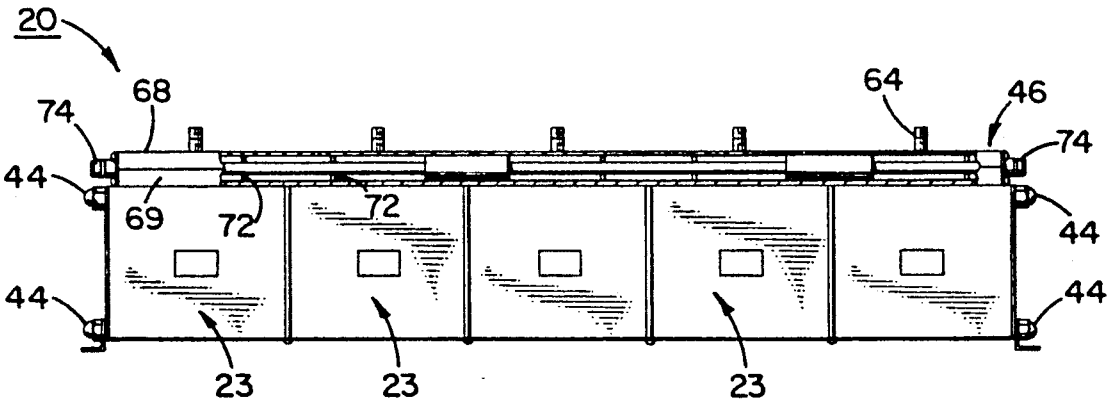
FIG. 9 is a front elevational view of the modular dielectric notch filter shown in FIG. 8.

As also seen diagrammatically in FIG. 1, the structure of the modular resonant cavities incorporate rods 42 having threaded ends 43. The rods each have a length sufficient to extend through the combination of plates and shells forming the overall modular resonant cavities. As seen in FIGS. 8 and 9 illustrating a dielectric notch filter 20, nuts 44 are threaded to the ends of these rods so as to mechanically secure the overall modular dielectric notch filter into a mechanically rigid device. Although a four sided modular resonant cavity shell is shown in FIGS. 1 and 2, the cavity shell can have a different number of sides so long as it defines a through aperture 36. Indeed, the cavity shell may be cylindrical as shown by shell 24' in FIG. 2A with corresponding closure plates dimensioned for interfitting therewith, such as closure plate 26,,, which may be a divider plate between adjacent shells or an end closure plate. Holes 30' may be formed within the closure plate so as to secure the closure plates to the shell by means of rods or the like.

Figure 6:
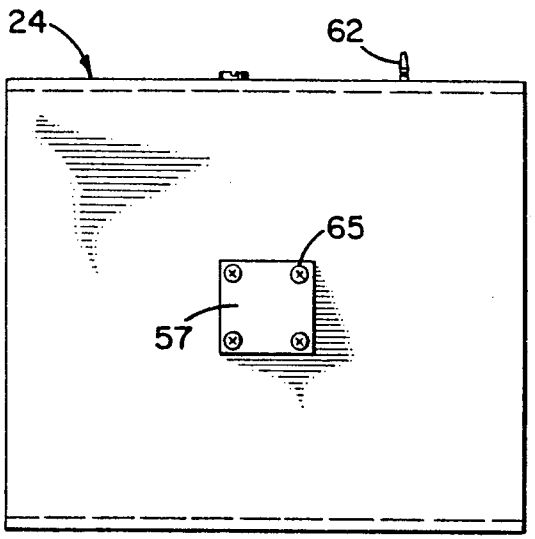
FIG. 6 is a side elevational view of the modular cavity shell shown in FIG. 5, illustrating the structure of the components forming the dielectric notch resonator.
Figure 7:
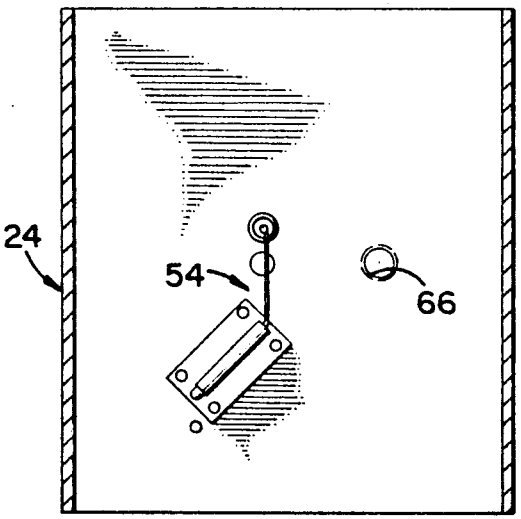
FIG. 7 is a cross-sectional view of the modular cavity shell taken along line 7—7 of FIG. 5.
Figure 5:
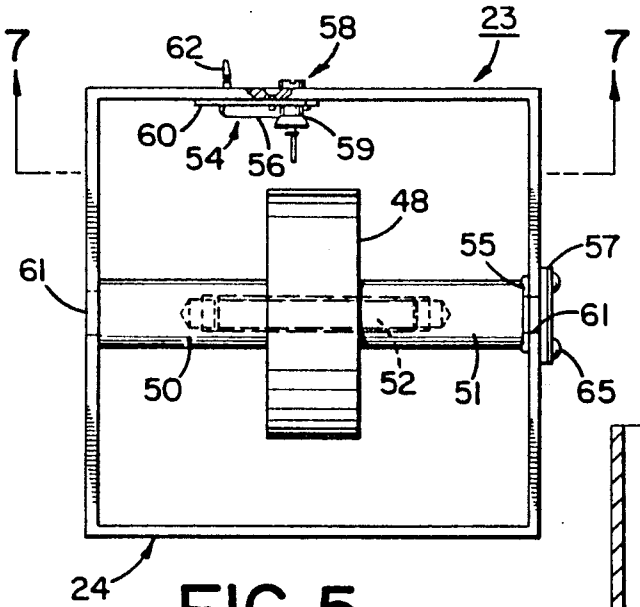
FIG. 5 is a rear elevational view of the modular cavity shell shown in FIGS. 1 and 2, illustrating its use to form a dielectric notch resonator.
Figure 13:
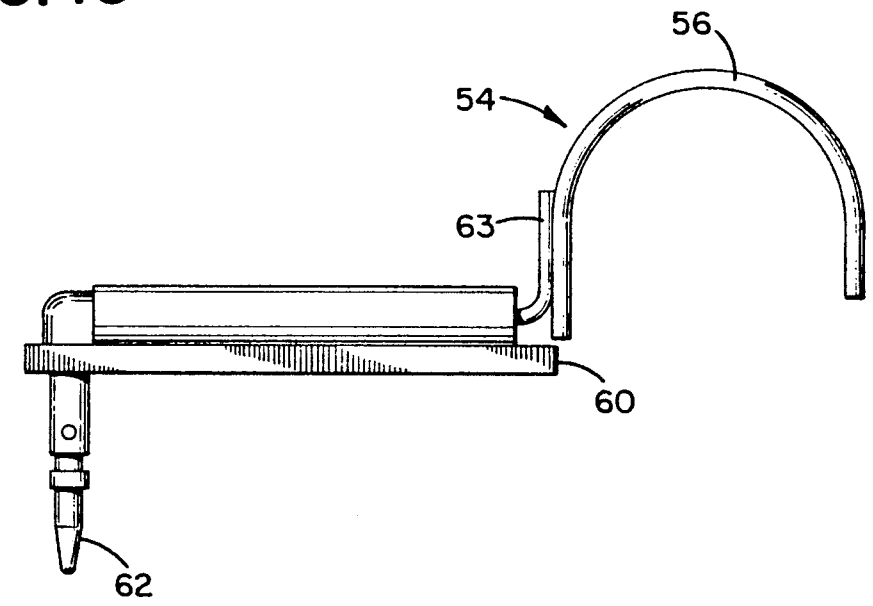
FIG. 13 is an enlarged side view of the loop assembly shown in FIGS. 5 and 7.

FIGS. 5, 6, and 7 illustrate a dielectric notch resonator 23 formed from a resonant cavity according to the present invention. As seen in FIGS. 5, 6, 7 and 12, the dielectric notch resonator comprises a resonator 48 which is centrally positioned within the interior space defined by shell 24 by support rods 50 and 51. A screw 52 which is threaded at both ends, passes through the resonator 48 and terminates within recesses 47 and 49 within support rods 50 and 51. The resonator is made of a ceramic material having a diameter of approximately 2.75 inches (6.99 cm) and a thickness of 1 inch (2.54 cm). Each support rod is fabricated from high density polyethylene, each having a length of approximately 2.1 inches (5.3 cm) and an outer diameter of 0.75 inch (1.9 cm). The interior recess of each rod is threaded so as to engage with screw 52. Screw 52 has an overall length of approximately 2.25 inch (5.72 cm) and is preferably fabricated from polysulfone. A compression 0-ring 55 and cover plate 57 are used to secure rod 51 to shell 24. Both rods 50 and 51 are positioned within holes 61 formed in shell 24. Cover plate 57 is secured to shell 24 by machine screws 65. As best seen in FIGS. 5, 7 and 13, a loop assembly 54 is attached to shell 24 for providing interconnection of the resonator to an interconnecting coupling transmission line or waveguide 46 (see FIGS. 8–10). This loop assembly also forms part of a coupling reactance element so as to null the reactive component of the dielectric resonator, thereby resulting in a highly attenuated resonate frequency having a small imaginary component about its center frequency. This particular design of an inductive loop and variable capacitor is disclosed in the present assignee's U.S. Pat. No. 4,896,125, entitled Dielectric Notch Resonator. The inductive loop 56 preferably has a radius of 0.332 inch (8.4 mm) with a wire diameter of 0.040 inch (1.0 mm) and is preferably fabricated from tin plated copper wire.

Variable capacitor 58 passes through shell 24 as shown in FIG. 5 and connects to end 59 of inductive loop 56. The variable capacitor for the dielectric notch resonator shown has a preferable variable capacitance of 8 to 10 picofarads (pf). As seen in FIGS. 5, 7 and 13, the loop assembly 54 is attached to shell 24 by means of a flange 60. A contact pin 62 is connected to the inductive loop 56 by means of wire 63 as seen in FIG. 13. The contact pin is designed for interfitting with a coupling transmission line. The variable capacitor and inductive loop of the present invention perform substantially the same function as corresponding components described in present assignee's U.S. Pat. No. 4,896,125.

Figure 10:
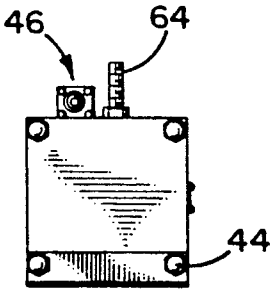
FIG. 10 is a side elevational view of the modular dielectric notch filter shown in FIGS. 8 and 9 taken along line 10—10 of FIG. 8.

As also seen in FIGS. 8, 9 and 10, each dielectric notch resonator may also comprise a tuning screw 64 which passes through shell 24 along hole 66 as seen in FIG. 7. The turning screw can adjust the center operating frequency of the dielectric notch resonator, typically in the range of 150 kilohertz. The tuning screw is preferably fabricated from aluminum rods having a diameter of approximately 0.375 inch (0.95 cm) and a length of from 1 inch (2.54 cm) to 2.75 inches (7.0 cm) depending upon the desired center frequency and mounting considerations of the overall filter.

Figure 11:
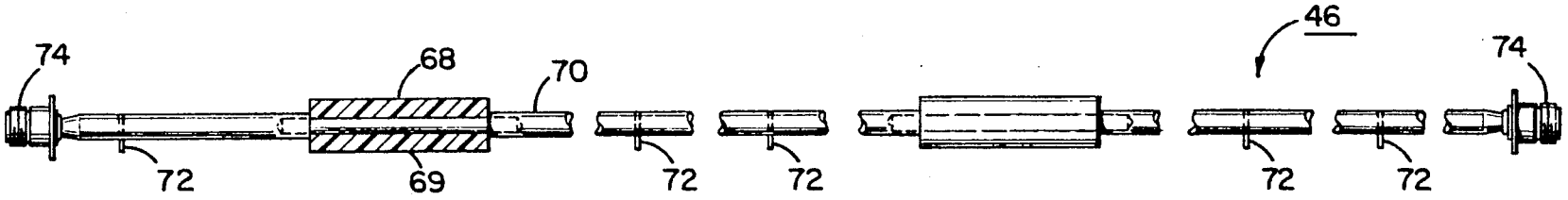
FIG. 11 is a partial cross-sectional view of the coupling transmission line used to interconnect the individual modular dielectric notch resonator to form the modular dielectric notch filter shown in FIGS. 8–10.
Figure 12:
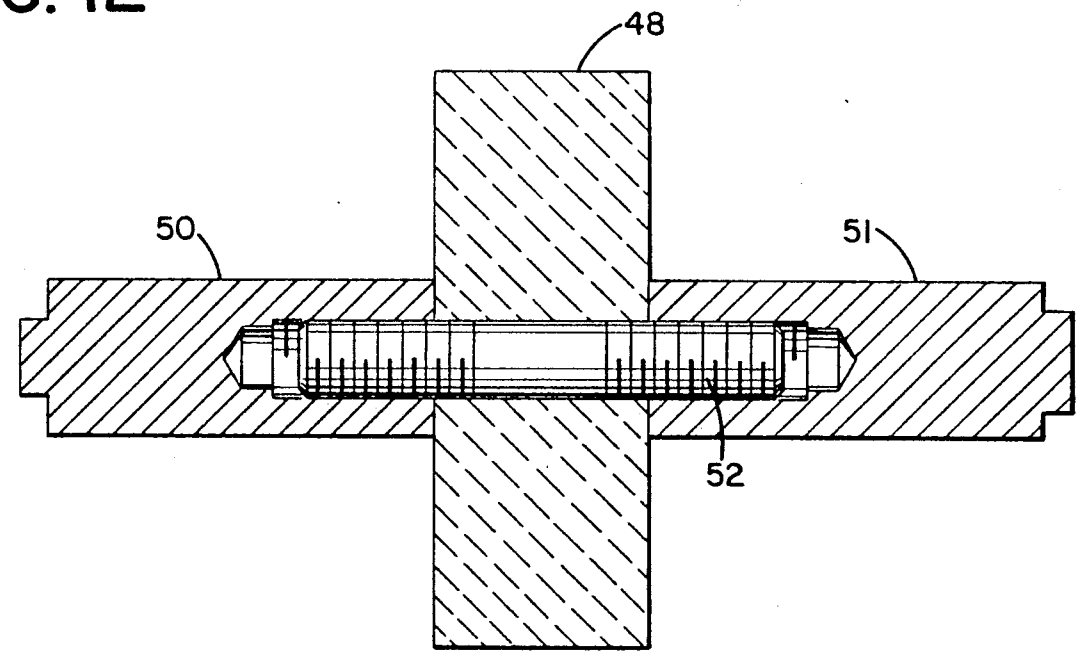
FIG. 12 is an enlarged, cross-sectional view of the support rods, screw, and dielectric resonator shown in FIG. 5.

FIGS. 8, 9 and 10 show a series of dielectric notch resonators using resonant cavities according to the present invention configured as a dielectric notch filter. As also seen in FIG. 11, a coupling transmission line or waveguide 46 comprises an upper extrusion 68 which, for the dielectric notch filter shown, has a preferred length of 28.3 inches (71.9 cm), with a bottom extrusion 69 having the same length. As seen in FIG. 9, a conductor 70 passes through the extrusion having connector pins 72 for mating with the contact pin 68 associated with each dielectric notch resonator. A connector 74 is mounted at each end of the transmission line for connection with electronic components.

Figure 14:
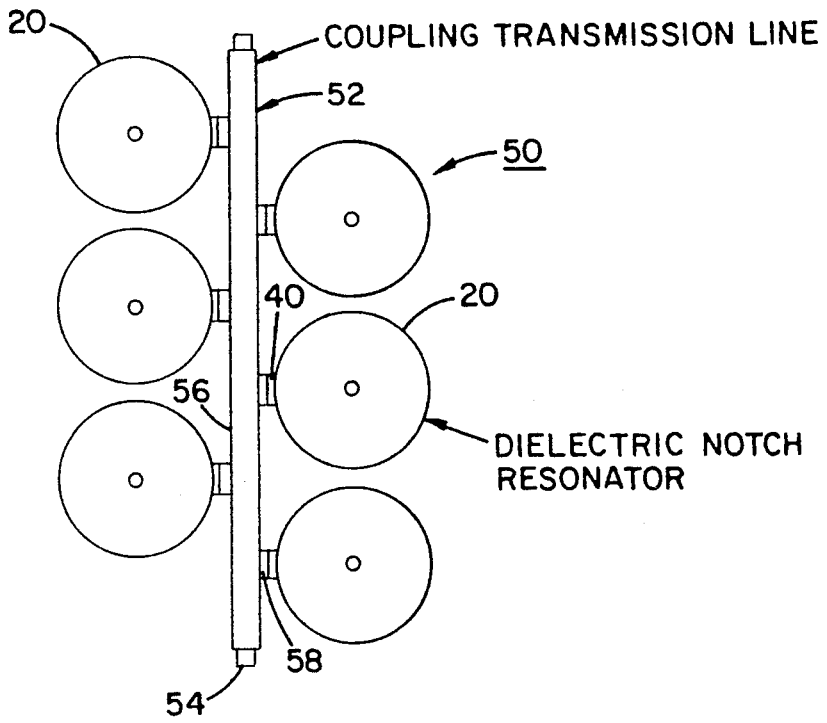
FIG. 14 (PRIOR ART)
FIG. 14 is a top view of a prior art dielectric notch filter.

The overall modular dielectric notch filter according to the present invention thereby achieves a compact and mechanically rigid overall configuration which is relatively easy to manufacture and which results in a relatively shorter coupling transmission line than that necessary for an equivalent dielectric notch filter fabricated using prior art techniques. For example, FIG. 14 shows a prior art dielectric notch filter disclosed in the present assignee's U.S. Pat. 4,862,122. This figure illustrates a coupling transmission line which is attached to a plurality of dielectric notch resonators where each such resonator incorporates a separate enclosure. Such dielectric notch resonators are unlike the present invention dielectric notch resonators where common walls are shared by adjacent resonators. The overall result is that the present invention achieves a dielectric notch filter having substantially the same characteristics as the prior art but in a configuration which is easier to fabricate and which is mechanically more rugged.

Thus the overall result is a modular resonant cavity which can be used to form dielectric notch resonators and filters. The resonant cavities are formed from an extrusion shell and associated closure plates which provide common walls between adjacent resonators. Such resonant cavities allow shorter coupling transmission lines to be used when fabricating dielectric notch filters or other devices that couple multiple resonant cavities, thereby reduces electrical losses associated with longer coupling transmission lines.

Although the preferred embodiment of the present invention is directed to use of such resonant cavities to form a dielectric notch filter having a preferred operating center frequency of approximately 845.75 megahertz, other frequencies could readily be designed through changing the physical size of the cavities and other components used to form the dielectric notch resonators. Furthermore, the present invention can also be used for other electromagnetic filter applications including bandpass filters, band stop filters, low pass filters, high pass filters, as well as any other electromagnetic applications where singular or multiple resonant cavities are required.

It is therefore seen that the objects set forth above and those made apparent from the preceding description are efficiently attained and, since certain changes may be made in the construction of the disclosed modular cavities and associated dielectric resonators and filters, it is intended that all matter contained in the above description and shown in the accompanying drawings be interpreted as illustrative and not in a limiting sense.

It is also to be understood that the following claims are intended to cover all of the generic and specific features of the invention described and all statements of the scope of the invention which, as a matter of language, might be said to fall therebetween.

Having described the invention, what is claimed is:

1. N modular resonant cavities for electromagnetic energy, where N is an integer greater than one, comprising:

(A) N multi-sided shells each defining an aperture passing therethrough, the aperture terminating t each end of the shell with an aperture perimeter formed by the shell;

(B) two solid end closure plates each having means for interfitting with one aperture perimeter of one multi-sided shell;

(C) N−1 solid divider closure plates each having means for interfitting with two adjacent multi-sided shells about a corresponding aperture perimeter thereof; and (D) means for securing the two end closure plates and the N−1 divider closure plates to the N multi-sided shells.

2. N modular resonant cavities as defined in claim 1, wherein each multi-sided shell comprises four sides.

3. N modular resonant cavities as defined in claim 2, wherein for each multi-sided shell, an angle is subtended between adjacent sides which has a value of approximately ninety degrees.

4. N modular resonant cavities as defined in claim 3, wherein for each multi-sided shell, each side has a longitudinal dimension perpendicular to the plane of each aperture opening that is slightly greater than the side dimension parallel to the plane of each aperture opening.

5. N modular resonant cavities for electromagnetic energy, where N is an integer greater than one, comprising:

(A) N multi-sided shells, each defining an aperture passing therethrough, the aperture terminating at each end of the shell with an aperture perimeter formed by the shell;

(B) two end closure plates, each having means for interfitting with one aperture perimeter of one multi-sided shell, said means comprising a stepped region protruding from the end closure plate dimensioned for interfitting with a multi-sided shell about one aperture perimeter thereof;

(C) N−1 divider closure plates, each having means for interfitting with two adjacent shells about a corresponding aperture perimeter thereof, said means comprising corresponding stepped regions protruding from opposite sides of the divider closure plate, each stepped region dimensioned for interfitting with an adjacent shell about one aperture perimeter thereof; and (D) means for securing the two end closure plates and the N−1 divider closure plates to the N multi-sided shells.

6. N modular resonant cavities as defined in claim 5, wherein the means for securing the end closure plates and the divider closure plates to the multi-sided shells comprises a plurality of rods dimensioned for extending through each multi-sided shell and each end closure plate and each divider closure plate, and further wherein each end closure plate and each divider closure plate has holes passing therethrough in corner regions thereof dimensioned for allowing the rods to pass therethrough, and further wherein the securing means comprises fasteners attached to the protruding ends of each rod so as to mechanically secure together the overall combination of end closure plates, divider closure plates and multi-sided shells.

7. N modular resonant cavities as defined in claim 6, wherein each multi-sided shell comprises four sides.

8. N modular resonant cavities as defined in claim 7, wherein for each multi-sided shell the angle subtended between adjacent sides is approximately ninety degrees.

9. N modular resonant cavities as defined in claim 8, wherein for each multi-sided shell, each side has a longitudinal dimension perpendicular to the plane of each aperture opening that is slightly greater than the side dimension parallel to the plane of each aperture opening.

10. N modular resonant cavities as defined in claim 9, wherein each shell is fabricated from aluminum extrusion.

11. N modular resonant cavities as defined in claim 10, wherein each shell is copper plated.

12. N modular resonant cavities as defined in claim 11, wherein each end closure plate and each divider closure plate is fabricated from aluminum.

13. N modular resonant cavities as defined in claim 12, wherein each end closure plate and each divider closure plate is copper plated.

14. N modular resonant cavities for resonating electromagnetic energy about a resonant frequency, where N is an integer greater than one, comprising:

(A) N cylindrical shells each defining an aperture passing therethrough, the aperture terminating at each end of the shell with an aperture perimeter formed by the shell;

(B) two solid end closure plates each having means for interfitting with one aperture perimeter of one shell;

(C) N−1 solid divider closure plates each having means for interfitting with two adjacent shells about a corresponding aperture perimeter thereof; and (D) means for securing the two end closure plates and the N−1 divider closure plates to the N shells.

15. N modular resonant cavities as defined in claim 14, wherein each shell is fabricated from aluminum extrusion.

16. N modular resonant cavities as defined in claim 15, wherein each shell is copper plated.

17. N modular resonant cavities as defined in claim 16, wherein each end closure plate and each divider closure plate is fabricated from aluminum.

18. N modular resonant cavities as defined in claim 17, wherein each end closure plate and each divider closure plate is copper plated.

19. N modular resonant cavities for electromagnetic energy, where N is an integer greater than one, comprising:

(A) N cylindrical shells, each defining an aperture passing therethrough, the aperture terminating at each end of the shell with an aperture perimeter formed by the shell;

(B) two end closure plates, each having means for interfitting with one aperture perimeter of one shell, said means comprising a stepped region protruding from the end closure plate dimensioned for interfitting with a cylindrical shell about one aperture perimeter thereof;

(C) N−1 divider closure plates, each having means for interfitting with two adjacent shells about a corresponding aperture perimeter thereof, said means comprising corresponding stepped regions protruding from opposite sides of the divider closure plate, each stepped region dimensioned for interfitting with an adjacent cylindrical shell about one aperture perimeter thereof; and (D) means for securing the two end closure plates and the N−1 divider closure plates to the N shells.

20. N modular resonant cavities as defined in claim 19, wherein the means for securing the end closure plates and the divider closure plates to the shells comprises a plurality of rods dimensioned for extending through each shell and each end closure plate and each divider closure plate, and further wherein each end closure plate and each divider closure plate has holes passing therethrough dimensioned for allowing the rods to pass therethrough, and further wherein the securing means comprises fasteners attached to the protruding ends of each rod so as to mechanically secure together the overall combination of end closure plates, divider closure plates and shells.

21. N modular resonant cavities for electromagnetic energy, where N is an integer greater than one, comprising:

(A) N cylindrical shells, each defining an aperture passing therethrough, the aperture terminating at each end of the shell with an aperture perimeter formed by the shell;

(B) two end closure plates, each having means for interfitting with one aperture perimeter of one cylindrical shell, and each having holes passing therethrough;

(C) N−1 divider closure plates, each having means for interfitting with two adjacent shells about a corresponding aperture perimeter thereof, and each having holes passing therethrough; and (D) means for securing the two end closure plates and the N−1 divider closure plates to the N shells, said means comprising a plurality of rods dimensioned for extending through each shell and the holes in each end closure plate and the holes in each divider closure plate, and further wherein said securing means comprises fasteners attached to the protruding ends of each rod so as to mechanically secure together the overall combination of end closure plates, divider closure plates and shells.

22. N modular dielectric notch resonators for resonating electromagnetic energy about N resonant center frequencies, where N is an integer greater than one, comprising:

(A) N multi-sided shells, each defining an aperture passing therethrough, the aperture terminating at each end of the shell with an aperture perimeter formed by the shell;

(B) two end closure plates, each having means for interfitting with one aperture perimeter of one shell;

(C) N−1 divider closure plates, each having means for interfitting with two adjacent shells about a corresponding aperture perimeter thereof;

(D) means for securing the two end closure plates and the N−1 divider closure plates to the N shell;

(E) N dielectric resonator;

(F) means for positioning each dielectric resonator respectively within the aperture defined by one of the shells, said means each comprising two support rods which span the space within the aperture and attach respectively to the opposite sides of the shell; and (G) means for providing external interconnection of the notch resonators.

23. N modular dielectric notch resonators for resonating electromagnetic energy about N resonant center frequencies, where N is an integer greater than one, comprising:

(A) N multi-sided shells each defining an aperture passing therethrough, the aperture terminating at each end of the shell with an aperture perimeter formed by the shell;

(B) two solid end closure plates each having means for interfitting with one aperture perimeter of one shell;

(C) N−1 solid divider closure plates each having means for interfitting with two adjacent shells about a corresponding aperture perimeter thereof;

(d) means for securing the two end closure plates and the N−1 divider closure plates to the N shells;

(E) N dielectric resonators;

(F) N means for positioning each dielectric resonator respectively within the aperture of one of the N shells; and (G) means for providing external interconnection of the notch resonators.

24. N modular dielectric notch resonators as defined in claim 23, further comprising means for adjusting the center frequency of each dielectric notch resonator.

25. N modular dielectric notch resonators as defined in claim 24, wherein each dielectric resonator is fabricated from a ceramic material.

26. N modular dielectric notch resonators as defined in claim 23, further comprising;

(H) a coupling reactance mechanism comprising:

(1) an inductive coupling wire, (2) a capacitive element connected to the coupling wire at one end so as to form therewith, a reactive element, and wherein the means for providing external interconnection of the notch resonators is connected to the second end of each coupling wire.

27. N modular dielectric notch resonators as defined in claim 26, wherein each capacitive element of each coupling reactance mechanism is a variable capacitor.

28. A modular dielectric notch filter for attenuating the signal strength of electromagnetic energy, comprising:

(A) N dielectric notch resonators, each for resonating about a center frequency, where N is an integer greater than one, each dielectric notch resonator comprising:

(1) N multi-sided shells, each defining an aperture passing therethrough, the aperture terminating at each end of the shell with an aperture perimeter formed by the shell, (2) two end closure plates, each having means for interfitting with one aperture perimeter of one multi-sided shell, (3) N−1 divider closure plates, each having means for interfitting with two adjacent multi-sided shells about a corresponding aperture perimeter thereof, (4) means for securing the two end closure plates and the N−1 divider closure plates to the N multi-sided shells, (5) N dielectric resonators, each fabricated from a ceramic material, (6) N means for positioning each dielectric resonator respectively within the aperture of one of the N shells, said means comprising two support rods which span the space within the aperture and attach respectively to opposite sides of the shell, (7) means for providing external interconnection of the notch resonators, and (8) means for adjusting the center frequency of each dielectric notch resonator; and (B) a coupling transmission means to which each dielectric notch resonator is attached by said interconnecting means of the dielectric notch resonator.

29. N modular dielectric notch resonators for resonating electromagnetic energy about N resonant center frequencies, where N is an integer greater than one, comprising:

(A) N cylindrical shells each defining an aperture passing therethrough, the aperture terminating at each end of the shell with an aperture perimeter formed by the shell;

(B) two solid end closure plates each having means for interfitting with one aperture perimeter of one cylindrical shell;

(C) N−1 solid divider closure plates each having means for interfitting with two adjacent shells about a corresponding aperture perimeter thereof; and (D) means for securing the two end closure plates and the N−1 divider closure plates to the N shells; p1

(E) N dielectric resonators;

(F) N means for positioning each dielectric resonator respectively within the aperture of one of the N shells; and (G) means for providing external interconnection of the notch resonators.

30. N modular dielectric notch resonators as defined in claim 29, further comprising means for adjusting the center frequency of each dielectric notch resonator.

31. A modular dielectric notch filter for attenuating the signal strength of electromagnetic energy, comprising:

(A) N dielectric notch resonators, each for resonating about a center frequency, where N is an integer greater than one, each dielectric notch resonator comprising:

(1) N multi-sided shells each defining an aperture passing therethrough, the aperture terminating at each end of the shell with an aperture perimeter formed by the shell;

(2) two solid end closure plates each having means for interfitting with one aperture perimeter of one multi-sided shell, (3) N−1 solid divider closure plates each having means for interfitting with two adjacent multi-sided shells about a corresponding aperture perimeter, (4) means for securing the two end closure plates and the N−1 divider closure plates to the N multi-sided shells, (5) N dielectric resonators, (6) N means for positioning each dielectric resonator respectively within the aperture of one of the N shells, and (7) means for providing external interconnection of the notch resonators; and (B) a coupling transmission means to which each dielectric notch resonator is attached by said interconnecting means of the dielectric notch resonator.

32. A modular dielectric notch filter as defined in claim 31, further comprising means for adjusting the center frequency of each dielectric notch resonator.

33. A modular dielectric notch filter as defined in claim 32, wherein each dielectric resonator is fabricated from a ceramic material.

34. A modular dielectric notch filter as defined in claim 31, further comprising;

(8) a coupling reactance mechanism comprising:

(a) an inductive coupling wire, and (b) a capacitive element connected to the coupling wire at one end so as to form therewith, a reactive element;

and wherein the means for providing external interconnection of the notch resonators is connected to the second end of each coupling wire.

35. A modular dielectric notch filter as defined in claim 34, wherein the coupling transmission means comprises an elongated center conductor and an extrusion shell spaced about the center conductor, and connector pins extending from the center conductor for mating with the means for providing external interconnection of the notch resonators.

36. A modular dielectric notch filter as defined in claim 33, wherein the coupling transmission means comprises an elongated center conductor and an extrusion shell spaced about the center conductor, and connector pins extending from the center conductor for mating with the means for providing external interconnection of the notch resonators

37. A modular dielectric notch filter for attenuating the signal strength of electromagnetic energy, comprising:

(A) N dielectric notch resonators, each for resonating about a center frequency, where N is an integer greater than one, each dielectric notch resonator comprising:

(1) N cylindrical shells each defining an aperture passing therethrough, the aperture terminating at each end of the shell with an aperture perimeter formed by the shell;

(2) two solid end closure plates each having means for interfitting with one aperture perimeter of one cylindrical shell;

(3) N−1 solid divider closure plates each having means for interfitting with two adjacent cylindrical shells about a corresponding aperture perimeter thereof; and (4) means for securing the two end closure plates and the N−1 divider closure plates to the N cylindrical shells, (5) N dielectric resonators, (6) N means for positioning each dielectric resonator respectively within the aperture of one of the N shells; and (7) means for providing external interconnection of the notch resonators; and (B) a coupling transmission mans to which each dielectric notch resonator is attached by said interconnecting means of the dielectric notch resonator.

38. A modular dielectric notch filter as defined in claim 37, further comprising means for adjusting the center frequency of each dielectric notch resonator.

* * * * *

UNITED STATES PATENT AND TRADEMARK OFFICE

CERTIFICATE OF CORRECTION

PATENT NO. : 5,051,714

DATED : September 24, 1991

INVENTOR(S) : Bentivenga et al

It is certified that error appears in the above-identified patent and that said Letters Patent is hereby corrected as shown below:

At column 10, line 20, please delete "(d)" and insert --(D)--;

at column 11, line 33, please delete "pl";

at column 11, line 34, please eliminate one tabulation so that "(E)" will line up properly; and at column 12, line 62, please delete "mans" and insert --means--.

Signed and Sealed this

Twelfth Day of January, 1993

*Attest:*

*Attesting Officer*

DOUGLAS B. COMER

*Acting Commissioner of Patents and Trademarks*